US007537131B2

(12) United States Patent
Hansen

(10) Patent No.: US 7,537,131 B2
(45) Date of Patent: May 26, 2009

(54) ONE-PIECE DOUBLE-CHAMBER CONTAINER

(76) Inventor: Bernd Hansen, Talstrasse 22-30, 74429 Sulzbach-Laufen (DE)

( * ) Notice: Subject to any disclaimer, the term of this patent is extended or adjusted under 35 U.S.C. 154(b) by 566 days.

(21) Appl. No.: 10/543,591

(22) PCT Filed: Nov. 13, 2003

(86) PCT No.: PCT/EP03/12677

§ 371 (c)(1),
(2), (4) Date: Jul. 27, 2005

(87) PCT Pub. No.: WO2004/069686

PCT Pub. Date: Aug. 19, 2004

(65) Prior Publication Data

US 2006/0144853 A1 Jul. 6, 2006

(30) Foreign Application Priority Data

Feb. 5, 2003 (DE) ..... 103 04 500

(51) Int. Cl.
*B65D 49/00* (2006.01)

(52) U.S. Cl. ..... 220/23.86; 220/522; 215/49; 215/DIG. 8; 206/219; 206/568; 206/820

(58) Field of Classification Search ..... 206/219, 206/222, 568, 820; 215/47, 48, 49, 6, DIG. 8; 220/23.83, 23.86, 521, 522, 796
See application file for complete search history.

(56) References Cited

U.S. PATENT DOCUMENTS 3,809,289 A 5/1974 Komendowski
4,266,681 A * 5/1981 Fredericks ..... 215/47
5,009,309 A * 4/1991 Hansen ..... 206/219
5,114,011 A * 5/1992 Robbins, III ..... 206/499
5,520,677 A * 5/1996 Hansen ..... 604/403
5,826,737 A * 10/1998 Zakensberg ..... 215/47
5,897,009 A * 4/1999 O'Meara ..... 215/48
6,022,134 A * 2/2000 Andrews ..... 366/130
6,247,617 B1 6/2001 Clyde et al.
6,412,526 B2 * 7/2002 Castillo ..... 141/100

FOREIGN PATENT DOCUMENTS

DE 26 38 561 3/1978

(Continued)

*Primary Examiner*—Anthony D Stashick
*Assistant Examiner*—Ned A Walker
(74) *Attorney, Agent, or Firm*—Roylance, Abrams, Berdo & Goodman, L.L.P.

(57) ABSTRACT

A container (3) includes an opening (8) for dispensing flowable or pourable substances located in the container and a closing device (11) closing the opening (8) and removable to free the opening (8). An auxiliary receptacle (13) is provided for holding an additive (27) to be added to the contents of the container (3), and is detachably attached to the container (3). The auxiliary receptacle comprises a discharge opening which can be freed by removing a closure and which is provided for discharging the additive (27), and can be placed with its freed discharge opening on the opening (8) of the container (3) after removing its closure device (11) to form a passage. That passage is provided for adding the additive (27), is sealed from the outside and extends between the auxiliary receptacle (13) and container (3).

6 Claims, 3 Drawing Sheets

FOREIGN PATENT DOCUMENTS

| | | | |
|---|---|---|---|
| DE | 38 33 036 | A1 | 4/1990 |
| DE | 40 11071 | A1 | 11/1990 |
| DE | 197 06 932 | A1 | 8/1998 |
| DE | 199 58 920 | C2 | 6/2001 |
| WO | WO 97/40820 | | 11/1997 |

* cited by examiner

ONE-PIECE DOUBLE-CHAMBER CONTAINER

The present invention relates to a container with an opening for delivery of flowable or pourable materials present in the container and with a closure device closing the opening and removable for clearance of the opening.

BACKGROUND OF THE INVENTION

Such containers filled with contents to be delivered are known in the most varied forms and for different uses of the delivered contents. For example, they can be ampule-like containers which contain pharmaceuticals which must be delivered from the container for injection purposes, infusion purposes or the like.

In the areas of medical applications and generally technical applications in which contents to be delivered from a container are used for treatment or processing procedures, to some extent the problem arises that the substance to be delivered is a composition of agents which are incompatible with respect to joint storage suitability. In other words, these agents which must be stored separately may only be combined to form the material to be delivered from the container when use of this binary substance takes place. The requirement of separate storage and combination of the agents which takes place before use leads disadvantageously to increased storage effort and awkward handling.

SUMMARY OF THE INVENTION

An object of the present invention is to provide a container that facilitates simplified storage and handling of two agents that must be stored separately and combined prior to use.

In a container, this object is basically achieved by an auxiliary receptacle being provided for accommodating an additive to be added to the contents of a container and being removably attached to the container. The auxiliary container has an outlet which can be cleared by removing a closure for the discharge of the additive. The auxiliary receptacle cleared outlet can be attached to the opening of the container after removal of its closure to form a passage which is sealed to the outside between the auxiliary receptacle and the container for adding the additive.

Storage is simplified by the detachable connection of the present invention between the container and the auxiliary receptacle which contains the additive because the two agents, although they are separate from one another, form one storage unit. The handling necessary for delivery of the substance is greatly simplified because the addition of the additive to the container contents takes place especially easily and conveniently. The auxiliary receptacle can be coupled with its outlet to the opening of the container. The unit including the container and auxiliary receptacle attached to its opening can be shaken, for example, to induce the required mixing of the two agents, or, when the additive is an agent of a specific particle size which can be shaken in the form of a single large particle, for example, a tablet, to move it through the passage between the auxiliary receptacle and the container.

When the substances to be delivered are highly-sensitive products, as is the case for pharmaceuticals, where international standards for aseptic packaging must be met, the container is advantageously produced using the process known in the pertinent technology as the Bottelpack® system. This process enables cost-effective automated forming (blowing or vacuum forming), charging and sealing of receptacles.

According to this system or when using another production process, preferably the container with its closure device and the auxiliary receptacle with its closure are produced from plastic as a one-piece body. Weak points are formed in the body which constitute desired break points at which the closure device of the container and the auxiliary receptacle can be removed and separated from the container. In this way, both the container can be opened very easily, and the auxiliary receptacle can be removed to be able to handle it separately.

Preferably, on the outlet of the auxiliary receptacle, a weak point is also formed which constitutes desired break point for separation of the closure of the auxiliary receptacle for clearance of its outlet.

When the container is a type of ampule with an opening provided on a neck part projecting coaxially to the main axis of the ampule, the body forming the unit including the container and auxiliary receptacle can be configured such that the neck area of the ampule is lengthened by an extension. The extension extends in the direction of the main axis of the ampule, and has weak points which form the desired break points for the container closure and the auxiliary receptacle.

This extension of the body can be formed in partial areas which border the closure device of the container and the closure of the auxiliary receptacle in the form of flat plates. Grasping surfaces are then formed by which the closure device and the auxiliary receptacle can be easily separated from the container at the desired break points.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

With reference to the figures, the present invention is explained using the example of an ampule container produced in one piece from thermoplastic using the Bottelpack® system, as known in the pertinent art. In this process for producing and charging containers, at least one tube of softened plastic material is extruded into an opened mold. In the course of closing the lower parts of the mold, welding processes are carried out on the tube to form the container bottom. The tube, or in the event that several containers are being formed, the tubes, is or are cut off above the mold by a cutting element to form the pertinent fill opening. The mold is then moved with the unit having the open fill opening or the open fill openings into a charging position in which the container or containers, after the container shape has been formed by expansion by blown air or vacuum molding, is filled with the contents. Then, a head welding process is carried out on the top of the container or containers, by which the closure of the filled unit is produced.

Figure 1:
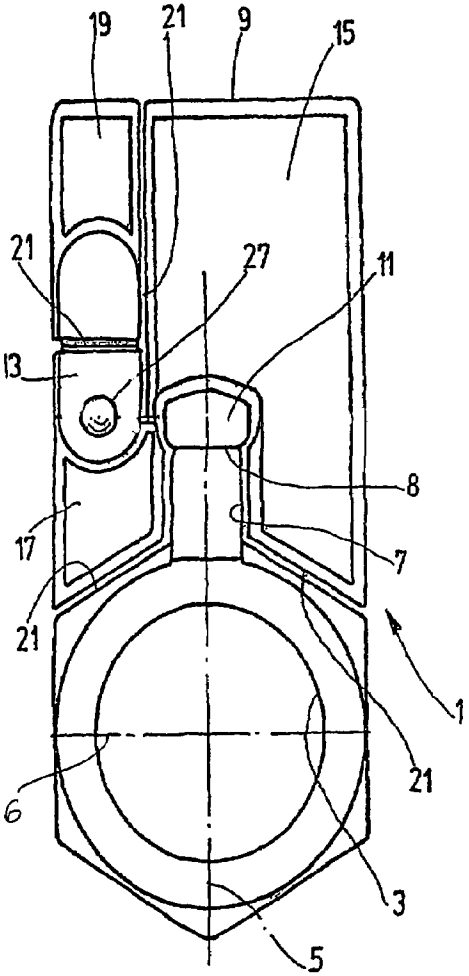
FIG. 1 is a schematically simplified, front elevational view of a container according to one embodiment of the present invention in the form of an ampule with an auxiliary receptacle located on the container and containing an additive in the form of a tablet.

FIG. 1 shows a unit 1 which has been produced according to the Bottelpack® system, with a one-piece body. A filled, ampule-like container 3 forms the lower end part of the body. The container 3 has a neck part 7 projecting coaxially up along the main axis 5 of the ampule to the container opening 8. On the neck part 7, a body extension 9 extends upwardly along the main axis 5 of the ampule. As shown in FIG. 1, a closure device 11 forming the closure of the opening 8 of the container and an auxiliary receptacle 13 are formed as integral components of the body extension 9. Between the components of the body extension 9, weak points 21 are formed which constitute desired break points for separating the components and for the removal of the closure device 11 from the container opening 8.

Figure 2:
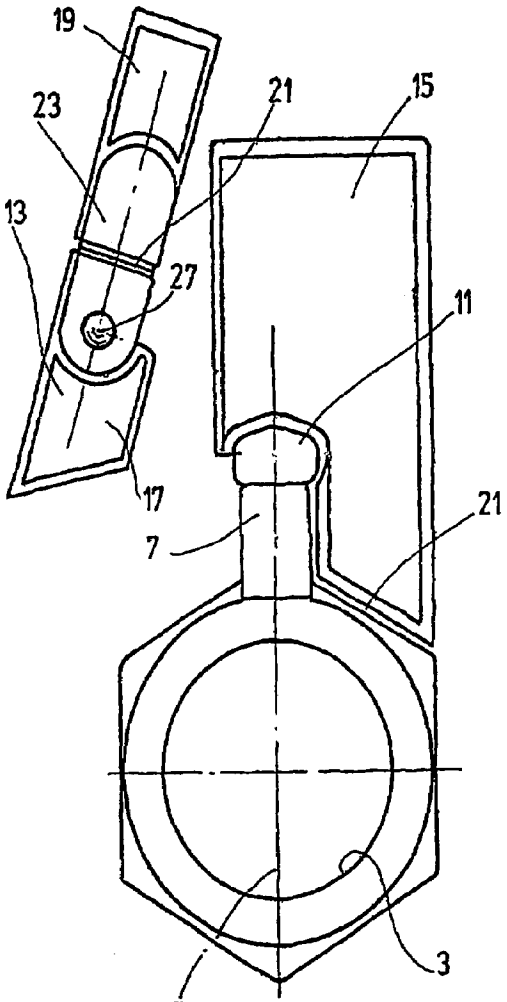
FIGS. 2 to 6 are exploded front elevational views of the container of FIG. 1 with the components of the container being shown in different operating states corresponding to successive handling steps when the container is being used.
Figure 3:
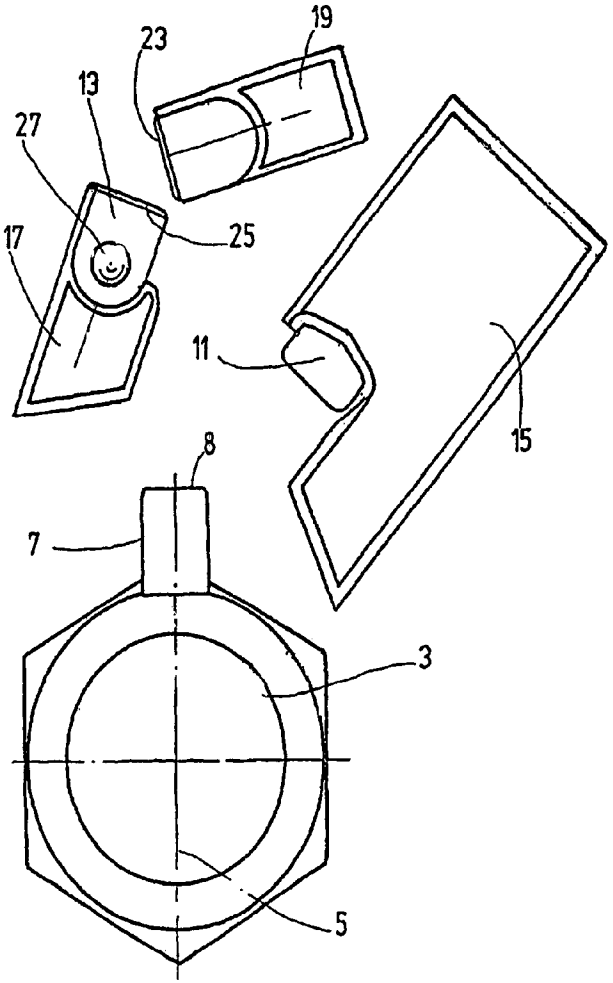

As shown most clearly in FIGS. 2 and 3, the body extension 9 has partial areas in the form of flat plates 15, 17, and 19. They form grasping surfaces for facilitating the removal of the components forming the body extension 9 at the desired break points and from the ampule-like container 3. FIG. 2 shows the operating state in which the auxiliary receptacle 13 has been removed from the rest of the unit. FIG. 3 shows the next following operating state during use, in which by use of the grasping surfaces 17 and 19, the closure 23 of the auxiliary receptacle 13 is removed by separation at the pertinent desired break points to clear the outlet 25 of the auxiliary receptacle 13. Moreover, FIG. 3 shows that the closure device 11 is separated from the neck area 7 of the container 3 using the grasping surface 15 to clear its opening 8. The body extension 9, by including plates 15, 17 and 19, receptacle 13 and closure 23, extends in a direction of a transverse axis 6, perpendicular to main axis 5 of ampule 3 over a width corresponding to the ampule within the direction of transverse axis 6.

Figure 4:
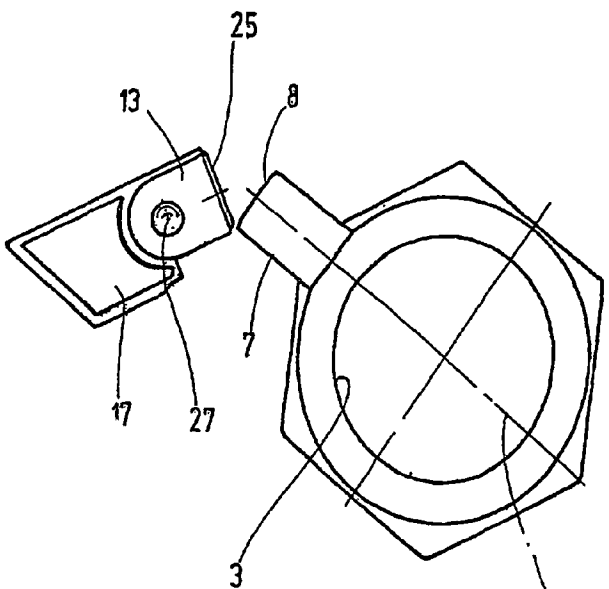
Figure 6:
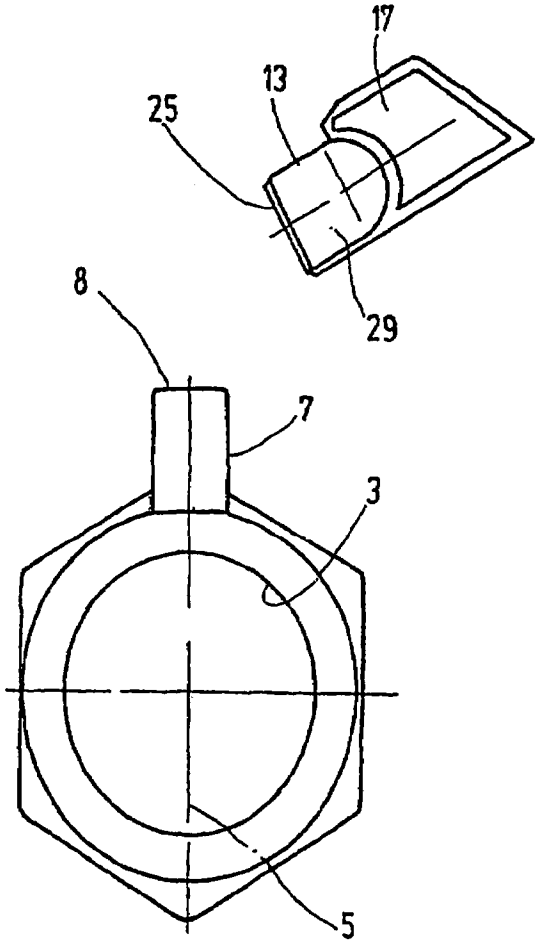
Figure 5:
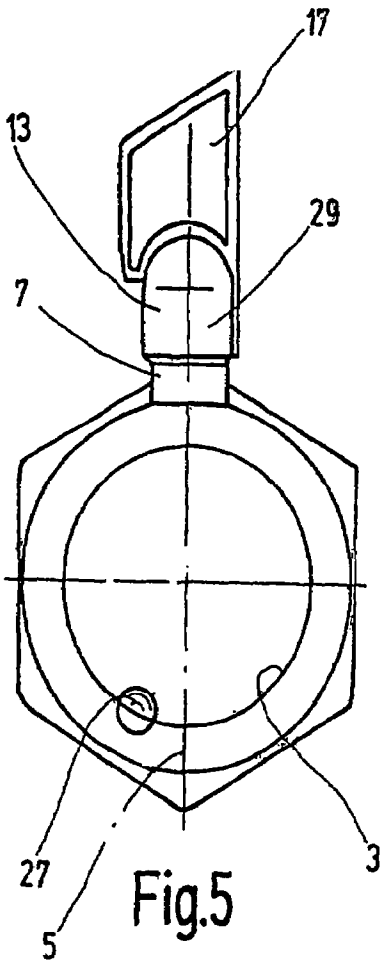

FIG. 4 shows the operating stage which follows during use, in which the auxiliary receptacle 13 with the additive contained in it in the form of a tablet 27 is brought to the opening 8 of the container 3 in order to dispense the tablet 27 into the container 3 by the outlet 25 and the opening 8. As FIG. 5 shows, the outlet 25 on the auxiliary receptacle 13 forms a coupling sleeve 29 which can be slipped onto the neck part 7 and which matches or mates with the neck part 7 of the container 3. A passage is formed by neck part 7 and coupling sleeve 7, is sealed to the outside, and extends between the auxiliary receptacle 13 and the interior of the container 3. The unit reclosed in this way can now be shaken to dissolve the tablet 27 which has been added to the container 3 in the desired manner and to mix the additive which has been added to the container 3 with the other container contents. FIG. 6 shows that after removing the auxiliary receptacle 13, the contents of the container 3 which are now mixed with the additive can be delivered by the now cleared opening 8.

It will be understood that in place of the tablet 27 shown as an additive in the auxiliary receptacle 13, another additive which can be shaken or which is a liquid can be added to the contents of the container 3. The container 3 and the auxiliary receptacle 13 may be formed with other container shapes than those shown in the drawings. In place of the Bottelpack® system, other production processes can be used to form the unit with the container and auxiliary receptacle.

While one embodiment has been chosen to illustrate the invention, it will be understood by those skilled in the art that various changes and modifications can be made therein without departing from the scope of the invention as defined in the appended claims.

What is claimed is:

1. A container unit, comprising:

an ampule having a longitudinal axis, a body with contents, a neck part extending from said body coaxially to said longitudinal axis, an opening at an end of said neck part remote from said body and a removable closure device on said opening to clear said opening when removed;

an auxiliary receptacle containing an additive for said contents of said ampule and being removably attached to said ampule and formed as a unitary, one plastic piece with said ampule, said auxiliary receptacle having an outlet and a removable receptacle closure connected thereto by a weak point permitting discharge of said additive upon removal of said receptacle closure, said receptacle closure being independently operable from said closure device, said outlet being attachable to said opening of said ampule after removal of said receptacle closure and said closure device from said auxiliary receptacle and said ampule, respectively, to form a sealed passage therebetween for adding said additive to said contents;

weak points formed in said plastic piece, including between said closure device and said receptacle closure, to facilitate separation of said ampule and said auxiliary receptacle with said closure device and said receptacle closure sealed thereon, respectively; and a body extension extending along said longitudinal axis from said neck part and having weak points forming break points with said closure device of said ampule and with said auxiliary receptacle.

2. A container unit according to claim 1 wherein said body extension extends perpendicular to said longitudinal axis of said ampule over a width corresponding to an ampule width.

3. A container unit according to claim 2 wherein said body extension comprises partial areas bordering on said closure device of said ampule and said receptacle closure of said auxiliary receptacle, said partial areas being flat plates forming grasping surfaces facilitating removal of said closure device and said receptacle closure from said ampule and said auxiliary receptacle, respectively.

4. A container unit according to claim 3 wherein a grasping surface is on said auxiliary receptacle for removing said receptacle closure from said outlet.

5. A container unit according to claim 1 wherein said auxiliary receptacle forms a coupling sleeve after removal of said receptacle closure, said sleeve being able to be slipped onto said neck part and to form a sealed passage between said auxiliary receptacle and said ampule.

6. A container unit according to claim 1 wherein said auxiliary container is smaller than and is axially offset relative to said ampule.

* * * * *